US006681844B1

(12) United States Patent
Inoue et al.

(10) Patent No.: US 6,681,844 B1
(45) Date of Patent: Jan. 27, 2004

(54) PLATE TYPE HEAT EXCHANGER

(75) Inventors: Naoyuki Inoue, Tokyo (JP); Toshio Matsubara, Tokyo (JP); Tomoyoshi Irie, Tokyo (JP); Akiyoshi Suzuki, Tokyo (JP); Tomoyuki Uchimura, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/806,503

(22) PCT Filed: Oct. 15, 1999

(86) PCT No.: PCT/JP99/05700

§ 371 (c)(1),
(2), (4) Date: Apr. 13, 2001

(87) PCT Pub. No.: WO00/22364

PCT Pub. Date: Apr. 20, 2000

(30) Foreign Application Priority Data

Oct. 15, 1998 (JP) ..... 10-293493
Feb. 1, 1999 (JP) ..... 11-23747

(51) Int. Cl.[7] ..... F28D 9/00; F28F 25/06
(52) U.S. Cl. ..... 165/115; 165/167
(58) Field of Search ..... 165/163, 166, 165/167, 115

(56) References Cited

U.S. PATENT DOCUMENTS 3,258,832 A * 7/1966 Gertsung ..... 165/148
3,371,709 A * 3/1968 Rosenblad ..... 165/115
4,119,140 A * 10/1978 Cates ..... 165/67
4,162,703 A 7/1979 Bosaeus
4,216,002 A * 8/1980 Rosenblad ..... 203/87
4,407,359 A * 10/1983 Berger et al. ..... 165/167
4,696,342 A * 9/1987 Yamauchi et al. ..... 165/152
4,969,507 A * 11/1990 Rosenblad ..... 165/115
5,098,518 A * 3/1992 Sakai et al. ..... 159/13.1
5,509,471 A * 4/1996 Hallgren ..... 165/167
5,826,648 A 10/1998 Shimoya et al.
6,016,865 A * 1/2000 Blomgren ..... 165/148

FOREIGN PATENT DOCUMENTS

| | | |
|---|---|---|
| EP | 384612 | 8/1990 |
| EP | 0 650 024 A1 | 4/1995 |
| JP | 57-154874 | 9/1982 |
| JP | 62-172975 | 11/1987 |
| JP | 3-50463 | 3/1991 |
| JP | 7-167581 | 7/1995 |
| JP | 9-72685 | 3/1997 |
| JP | 9-89484 | 4/1997 |
| JP | 138082 | 5/1997 |
| JP | 9-170892 | 6/1997 |
| JP | 9-273825 | 10/1997 |
| NL | 4313506 | 10/1994 |
| RU | 215204 | 6/1941 |

* cited by examiner

*Primary Examiner*—Allen Flanigan
(74) *Attorney, Agent, or Firm*—Westerman, Hattori, Daniels & Adrian, LLP

(57) ABSTRACT

The present invention relates to a plate type heat exchanger having a heat exchange element composed of two plates for exchanging heat between a fluid flowing inside the heat exchange element and a fluid flowing outside the heat exchange element. In the plate type heat exchanger, the two plates (1) have a plurality of depressions (8), and the depressions are brought into contact with and bonded to each other. Peripheral portions of the plates are sealed to form a space in which a fluid flows and constitute a heat exchange element (2) having opening portions (5, 6) at both ends thereof. The heat exchange elements (2) are piled on and bonded to each other so that the opening portions (5, 6) communicate with each other.

9 Claims, 12 Drawing Sheets

PLATE TYPE HEAT EXCHANGER

TECHNICAL FIELD

The present invention relates to a plate type heat exchanger, and more particularly to a plate type heat exchanger for exchanging heat between two fluids flowing alternately through adjacent fluid passages between piled plates, which is suitable for such cases where at least one of the fluids flows as a liquid film on a surface of the plate, or is a low-pressure vapor, as an evaporator in a refrigerating machine, or an evaporator or a low-temperature regenerator in an absorption refrigerating machine.

BACKGROUND ART

A conventional plate type heat exchanger is of a small size for a heat load, and can cope with an increased heat load by increasing the number of piled plates having the same shape, so that the plate type heat exchanger is frequently used as a heat exchanger.

The conventional plate type heat exchanger is shown in FIG. 16. As shown in FIG. 16, two plates 1, 1' having opening portions 5, 6 at both ends thereof are piled on each other so as to form a space R1 therebetween, and peripheral portions of the plates are sealed to form a heat exchange element 2. The heat exchange elements 2 are piled on and bonded to each other in such a state that the opening portions 5, 6 communicate with each other, thereby forming a heat exchange structure. This heat exchange structure is housed in a shell, and fluids flow inside and outside the heat exchange elements 2 so as to exchange heat with each other. A corrugated or fin-shaped plate 42 is mounted within the space R1 in the heat exchange element 2 to increase the strength of the plates and promote heat exchange by turbulence of a flow. The upper and lower opening portions 5, 6 are projected in a cylindrical form so as to be fitted to each other.

In this type of heat exchanger, an inlet and an outlet for a first fluid passing through the shell are connected to the opening portions 5, 6. The first fluid flows in parallel through the respective heat exchange elements 2 as indicated by arrows. On the other hand, a second fluid flows from an inlet and an outlet for the second fluid, which are provided in the shell, into a space R2 formed outside the heat exchange elements 2. The outside space R2 can be made wider than the inside space R1. Therefore, when a fluid involving a phase change is used as the second fluid, the heat exchanger can cope with a volume change in accordance with the phase change. Further, the inlet and outlet for the outside space R2 can be made larger than the inlet and outlet for R1. Therefore, the heat exchanger can cope with a fluid that is a low-pressure vapor having a large specific volume. The outside space R2 can be made wider than the inside space R1 depending upon the shapes of projections and depressions of the plates, so that the heat exchanger can cope with even a lower-pressure vapor.

To manufacture such a heat exchanger, the turbulence plate. 42 is mounted and positioned on the upper plate 1. Then, the lower plate 1' is placed on the turbulence plate 42, and the peripheral portion of the lower plate 1' is folded to be bonded to the upper plate 1, for thereby forming the heat exchange element 2. Next, the adjacent heat exchange elements 2 are connected to each other so that cylindrical communicating portions 7 are fitted to each other, for thereby assembling a heat exchange structure. The resulting heat exchange structure is incorporated into a shell 9.

Such a conventional plate type heat exchanger requires three components for constituting the heat exchange element 2, and thus involves problems that manufacture and management of the components are burdensome and costly.

FIG. 17 is an exploded perspective view of a plate type heat exchanger in which a plurality of heat exchange elements 2 are piled on each other and housed within a shell 9.

With a plate type heat exchanger having a structure shown in FIG. 17, when the number of the heat exchange elements 2 is increased, heat exchange capacity can be improved. Further, a liquid having a large specific volume, such as a vapor or a vapor-liquid two phase fluid, can be used as an external fluid. In FIG. 17, the reference numeral 3 denotes an opening portion constituting an introduction passage for an external fluid, the reference numeral 4 an opening portion constituting a discharge passage for the external fluid, the reference numeral 5 an opening portion constituting an introduction passage (supply passage) for an internal fluid, the reference numeral 6 an opening portion constituting a discharge passage (supply passage) for the internal fluid, and the reference numeral 7 a cylindrical communicating portion.

It has been known that when the plate type heat exchanger having the structure shown in FIG. 17 is used in an absorber or an evaporator of an absorption refrigerating machine, for example, the refrigerating machine can be downsized.

In these heat exchangers, since an internal fluid is generally supplied to a plurality of plates, as shown in FIG. 17, the heat exchanger is used in such a state that an inlet and outlet of the heat exchanger and an inlet and outlet (ports) of the plates are connected to each other, and the ports of the plates are connected to each other, via supply passages such as supply pipes, discharge pipes, and communication pipes for a working fluid. In many cases, the supply passages are provided on heat transfer surfaces of the plates because of productivity in such a manner that the supply passages are faced to and communicate with each other when the plates are piled on each other.

In this case, when the flow rate of the internal fluid is increased, it is necessary to thicken the supply passages 5, 6. Therefore, the supply passages provided on the heat transfer surfaces occupy the heat transfer area, and simultaneously prevent a flow of the external fluid.

Particularly, as shown in FIG. 18, in such cases where the external fluid flows as a liquid film for performing heat exchange, as an absorber or an evaporator in an absorption refrigerating machine, if wide supply passages are provided, then it is difficult to supply the fluid to entire regions below the supply passages and hence the regions are not effectively used as the heat transfer surface in many cases. In FIG. 18, a hatched area represents regions of the flow of the fluid, and portions a below the supply passage 5, 6 without hatching represent regions of no fluid flowing.

Generally, in the plates, there is provided a fluid distribution portion having radial passages for uniformly distributing the fluid supplied from the ports to the plates. As the supply passage becomes wider, the fluid distribution portion becomes more complicated and larger, so that the fluid distribution portion occupys a larger area of the heat transfer surface.

Even if supply passages having an elliptic or rectangular shape are used to solve the above drawbacks, such supply passages increase cost and make productivity worse. Besides, a flow in a direction of the minor axis of the shape of the supply passage is worsened, although a flow in a direction of the major axis can be improved. This is not a solution to the problems.

DISCLOSURE OF INVENTION

The present invention has been made in view of the above drawbacks. It is therefore an object of the present invention to provide a plate type heat exchanger having a highly efficient function of heat exchange, which requires a small number of components and can reduce cost of production and assembly.

It is another object of the present invention to provide a plate type heat exchanger having a highly efficient function of heat exchange, which can be manufactured by a small man-hour and is likely not to prevent a flow of a working fluid even at a high flow rate.

To attain the above objects, according to a first aspect of the present invention, there is provided a plate type heat exchanger having a heat exchange element composed of two plates for exchanging heat between a fluid flowing inside the heat exchange element and a fluid flowing outside the heat exchange element, characterized in that: the two plates have a plurality of depressions, and the depressions are brought into contact with and bonded to each other; peripheral portions of the plates are sealed to form a space in which a fluid flows and constitute a heat exchange element having opening portions at both ends thereof; and the heat exchange elements are piled on and bonded to each other so that the opening portions communicate with each other.

In the plate type heat exchanger, it is desirable that the depressions of the plate are formed in a circular shape or a horizontally elongated elliptic shape, and a contacting portion between projections produced by the depressions has a plane surface of at least 0.3 mm in width.

The peripheral portions of the two plates may be brought into contact with each other along whole peripheries upon piling, and contacting portions between the peripheral portions may be sealing by bonding. At least one of the opening portions at both ends of the plate may be composed of a plurality of opening portions.

According to a second aspect of the present invention, there is provided a plate type heat with opening portions at both ends thereof are piled as a set on each other to constitute a heat exchange element, a plurality of the heat exchange elements are piled on each other to form a space between the two plates constituting the respective heat exchange elements as a passage for a first fluid, and a space between the adjacent heat exchange elements as a passage for a second fluid in heat exchange relationship with the first fluid, and the plate serves as a heat transfer surface for both of the fluids, characterized in that: one of the plates has a contacting portion with the other plate at a peripheral portion of the plate and at the opening portion; when the two plates are piled as a set on each other, only the peripheral portions of the plates are brought into contact with each other; when the plates are pressed by an applied force until the projections and depressions of the two plates are brought into contact with each other, the contacting portions of the peripheral portions deform to be brought into surface contact with each other along whole peripheries; when the adjacent heat exchange elements are piled on each other in such a manner that the opening portions are aligned with each other, only the peripheral portions of the opening portions are brought into contact with each other; and when the plates are pressed by an applied force until the projections and depressions of the plates of the heat exchange elements are brought into contact with each other, the contacting portion of the respective peripheral portions of the opening portions deform to be brought into surface contact with each other along whole peripheries.

In the plate type heat exchanger, it is desirable that all of the plates are integrated by brazing the contacting portions at the peripheral portion and at the opening portions of the plates. The projections and depressions of the plate may be formed in a shape inclined to one direction. The projections and depressions of the plate may be formed as spot-like projections and depressions having a circular or other cross section, and the height of the projections may be larger than the depth of the depressions when the heat exchange element is constituted.

Further, it is desirable that the plate has a rising portion so that the rising portion is fitted into the opening portion of another plate when the plates are piled on each other.

According to a third aspect of the present invention, there is provided a plate type heat exchanger having a plurality of hollow plates in a shell, each of the hollow plates composed of two thin sheets and having an internal space enclosed at an outer peripheral portion thereof, an introduction passage and a discharge passage for allowing an internal fluid to flow inside the plates being connected to the plates, an introduction passage and a discharge passage for allowing an external fluid to flow within a space between the outside of the plates and the shell being connected to the shell, characterized in that: at least one of the introduction passage and the discharge passage for the internal fluid connected to each of the plates is composed of a plurality of passages.

BRIEF DESCRIPTION OF DRAWINGS

FIG. 1A is a front sectional view, and FIG. 1B is a side sectional view;

FIGS. 2A through 2C are enlarged plan views of depressions, and FIG. 2D is an enlarged sectional view of a heat exchange element;

FIG. 3A is a plan view, and FIG. 3B is a sectional view;

FIG. 6A shows a state before a load is applied, FIG. 6B shows a state after a load is applied, FIG. 6C is an enlarged view showing an example of a peripheral portion and an opening portion, and FIG. 6D is an enlarged view showing another example of a peripheral portion and an opening portion;

FIG. 14A is a front sectional view, and FIG. 14B is a side sectional view;

BEST MODE FOR CARRYING OUT THE INVENTION

Embodiments of a plate type heat exchanger according to the present invention will be described below in detail.

In a first embodiment of the present invention, two plates have a plurality of depressions, and the depressions are brought into contact with and bonded to each other to form a space in the plates, so that the strength of the plates is increased. The depressions prevent a flow of a fluid flowing between the plates, for thereby improving heat transfer. Thus, a heat exchanger having high efficiency can be constructed without provision of a turbulator (turbulence plate) conventionally inserted between the plates.

Next, the first embodiment of the present invention will be described below with reference to the accompanying drawings.

Figure 1A:
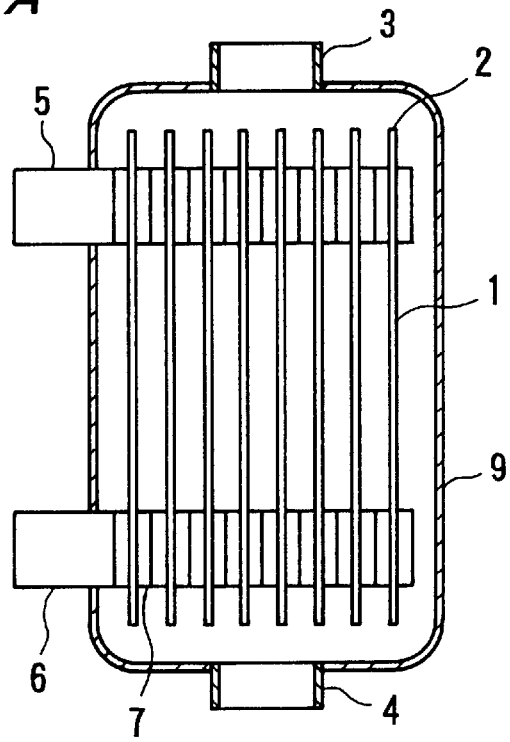
FIGS. 1A and 1B are schematic views showing a whole structure of a plate type heat exchanger according to a first embodiment of the present invention.
Figure 1B:
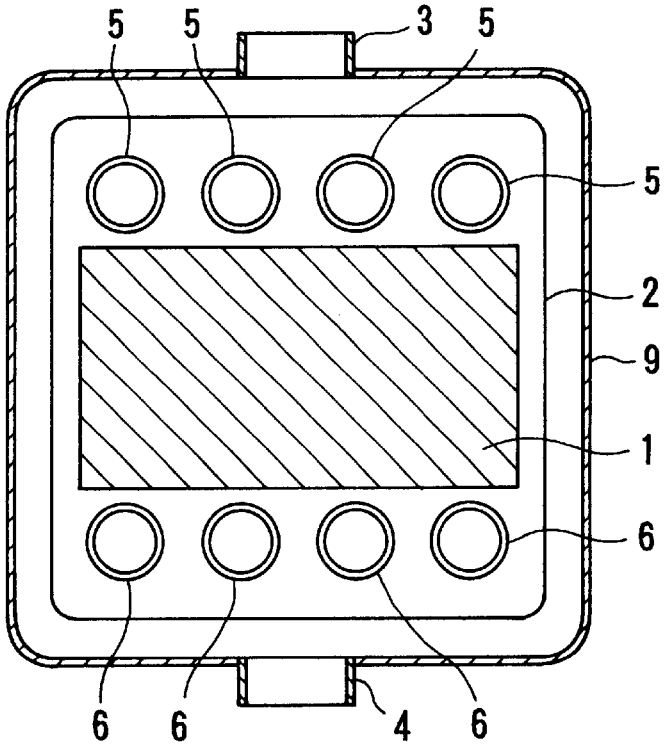

FIGS. 1A and 1B are schematic views showing a whole structure of a plate type heat exchanger according to the first embodiment of the present invention, and FIG. 1A is a front sectional view, and FIG. 1B is a side sectional view.

In FIGS. 1A and 1B, the reference numeral 1 denotes a plate, 2 a heat exchange element, 3 an external fluid introduction passage, 4 an external fluid discharge passage, 5 and 6 denote opening portions for introducing and discharging an internal fluid, 7 a communicating portion, and 9 a shell.

In the plate type heat exchanger shown in FIGS. 1A and 1B, eight heat exchange elements 2 composed of two plates 1 are housed in the shell 9. Four opening portions 5 and four opening portions 6 for introducing and discharging internal fluid passages are respectively provided in the plate 1. The internal fluid is introduced into the plates through the four opening portions 5 as the introduction passages, and is discharged through the four opening portions 6 as the discharge passages.

On the other hand, the external fluid is introduced through the single introduction passage 3, passes over the outer surface of each of the plates, and is discharged through the single discharge passage 4. Thus, heat is exchanged between the internal fluid and the external fluid.

Figure 2A:
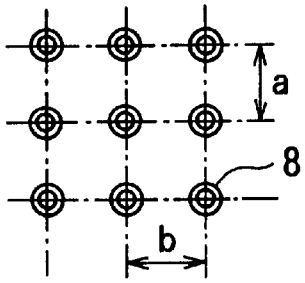
FIGS. 2A through 2D are enlarged views showing a shape of a plate according to the present invention.
Figure 2B:
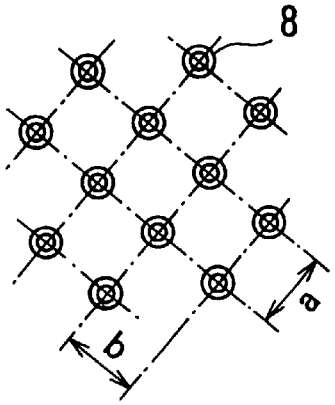
Figure 2C:
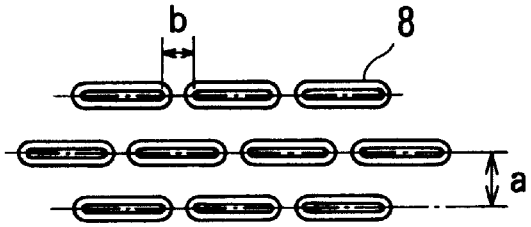
Figure 2D:
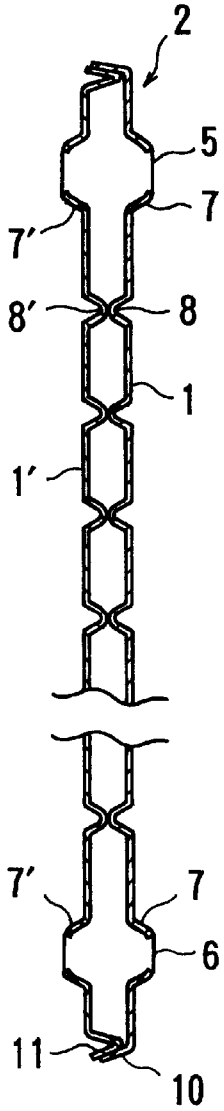

The shape of a hatching portion of the plate shown in FIG. 1B is shown as plan views in FIGS. 2A, 2B and 2C. FIG. 2D is an enlarged sectional view of the heat exchange element 2.

As shown in FIGS. 2A through 2D, according to the present invention, the plate 1 has depressions 8 of a circular or elliptic shape, and the depressions of the two plates are brought into contact with and bonded to each other to form the heat exchange element 2. Arrangement of the depressions 8 formed in the plate 1 can be selected, as desired, in connection with the strength of the plate. When the water pressure is 490 kPa (5 kgf/cm$^2$), the thickness of the plate is 0.3 to 0.5 mm, and the size of a contacting portion is 0.3 mm, for example, the depressions 8 may be arranged as follows:

In the case where the circular depressions are arranged in a checkered pattern or a staggered pattern as shown in FIGS. 2A and 2B, it is desirable that $0.5 \leqq a/b \leqq 2$ and $a \times b \leqq 250$ mm$^2$.

In the case where the depressions have a horizontally elongated elliptic shape as shown in FIG. 2C, it is desirable that $a \geqq b/2$, $a \leqq 20$ mm. In this case, when a is close to 20 mm, the flat portion of the plate slightly swells in use, which is acceptable for use.

In a peripheral portion of the heat exchange element 2, as shown in FIG. 2D, the plate 1 is bent once, and the plate 1' is bent twice, to thus form contact surfaces 10 and 11, which are inclined in parallel with each other. In FIGS. 1A and 1B, the two plates are indicated by the reference numeral 1. In FIG. 2D, the two plates are distinguished from each other by the different reference numerals 1 and 1'. The depressions formed in the respective plates 1 and 1' are also distinguished from each other by the different reference numerals 8 and 8'. The plates 1, 1' are constructed so that the depressions 8, 8' are brought into contact with each other when the contact surfaces 10, 11 of the plates 1, 1' are piled on each other. The plates 1, 1' having the same shape, except their peripheral portions, are piled on each other in opposite directions.

At least one of the surfaces of the plates 1, 1' is formed as a roughened surface to increase the wettability of the fluid involving a phase change on the plate surface. The two plates 1 and 1' are piled on each other, and the contacting portions of the depressions 8, 8' and the peripheral portions 10, 11 are welded or brazed to be bonded to each other, for thereby constituting the heat exchange element 2.

The communicating portions 7, 7' of the heat exchange elements 2 are welded or brazed to be bonded to each other to form the plate type heat exchanger. In the example shown in FIG. 1A, eight heat exchange elements 2 are piled on and bonded to each other, and incorporated in the shell 9.

Figure 3A:
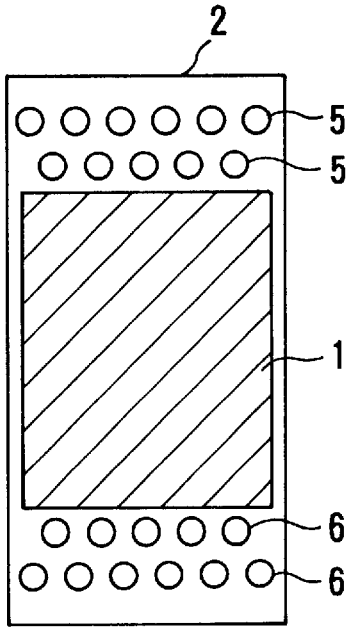
FIGS. 3A and 3B are schematic views showing a structure of another heat exchange element according to the present invention.
Figure 3B:
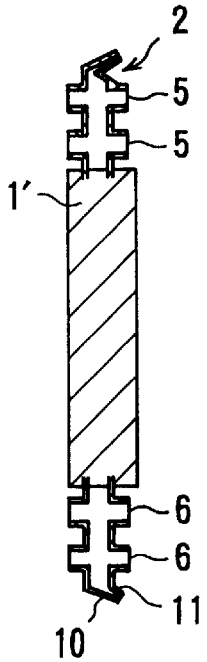

FIGS. 3A and 3B show a structure of another heat exchange element according to the present invention, and FIG. 3A is a plan view, and FIG. 3B is a sectional view. In the example shown in FIGS. 3A and 3B, a large number of opening portions 5, 6 of the plate are provided in a staggered pattern. The pattern shown in FIGS. 2A through 2C may be applied to a hatching portion shown in FIG. 3A.

Figure 4:
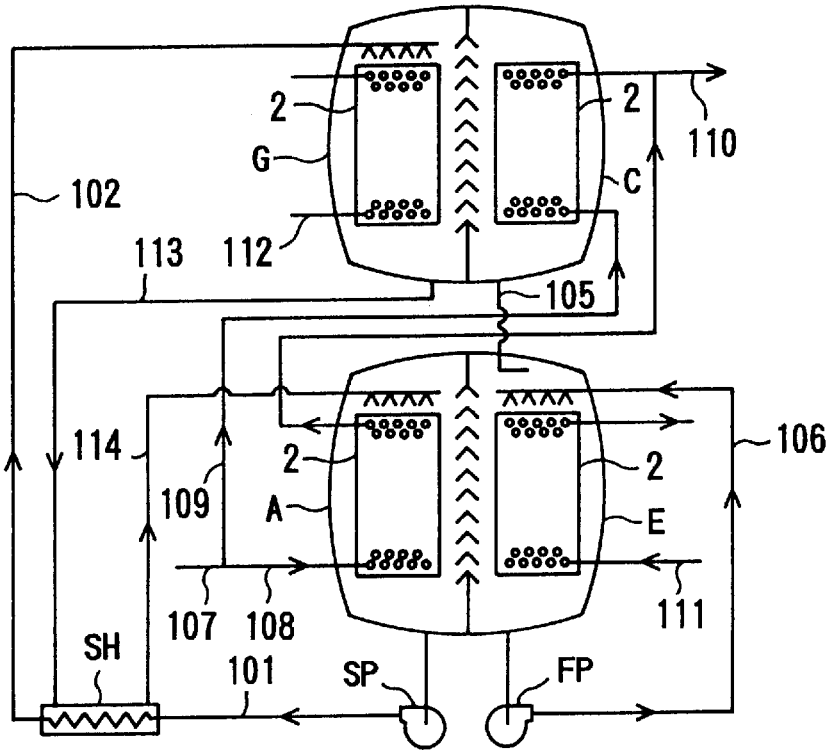
FIG. 4 is a schematic view showing a whole structure of an absorption refrigerating machine into which a heat exchanger of the present invention is incorporated.

FIG. 4 is a schematic view showing an example of using an absorption refrigerating machine into which a heat exchanger according to the present invention is incorporated. In this example, the heat exchange element 2 shown in FIGS. 3A and 3B is incorporated into each of an absorber A, a condenser C, a generator G, and an evaporator E. In the absorption refrigerating machine, as an internal fluid for the heat exchange element 2, cooling water flows in the absorber A and the condenser C, a heating medium flows in the generator G, and chilled water flows in the evaporator E. In the absorber A, a concentrated solution as an external fluid is cooled and absorbs a refrigerant from the evaporator E. In the generator G, a dilute solution as an external fluid is heated to evaporate the refrigerant and changes into a concentrated solution. In the condenser C, a refrigerant vapor from the generator G is cooled to form a refrigerant liquid. In the evaporator E, the refrigerant liquid is evaporated to form a refrigerant vapor.

The absorption refrigerating machine shown in FIG. 4 will be described below. In the absorber A, a concentrated solution absorbs a refrigerant vapor evaporated in the evaporator E to change into a dilute solution. The dilute solution is passed through a passage 101 and a heated side of a solution heat exchanger SH, and then introduced into the generator G via a passage 102 by a solution pump SP. The dilute solution introduced into the generator G is heated by a heat source 112 to evaporate the refrigerant, so that the dilute solution changes into a concentrated solution. The concentrated solution is passed through a passage 113 and the heating side of the solution heat exchanger SH, and then introduced via a passage 114 into the absorber A, where the concentrated solution absorbs a refrigerant vapor again to change into a dilute solution. Thus, the solution is circulated.

On the other hand, the refrigerant is evaporated in the generator G to become a refrigerant vapor. The refrigerant vapor reaches the condenser C, where the refrigerant vapor is condensed into a refrigerant liquid, which is introduced into the evaporator E via a passage 105. While the introduced refrigerant liquid is circulated into the evaporator E via a passage 106 by the refrigerant pump FP, the refrigerant liquid is evaporated in the evaporator E for cooling chilled water 111. The evaporated refrigerant reaches the absorber A, where the refrigerant is absorbed into the concentrated solution. The absorbed refrigerant reaches the generator G, where the refrigerant is evaporated. Thus, the refrigerant is circulated.

The cooling water is introduced through a passage 107 and branched into a flow through a passage 108 and a flow through a passage 109. These flows are respectively introduced into the absorber A and the condenser C and discharged through a passage 110.

According to the first aspect of the present invention, since the depressions of the plates are brought into contact with and bonded to each other, the strength of the plates is increased, and a flow of a fluid flowing between the plates can simultaneously be disturbed. Hence, since there is no need to insert a turbulator (turbulence plate) between the plates, the number of required components can be decreased, and the cost of production and assembly can be reduced. Further, a plate type heat exchanger according to the present invention has a highly efficient function of heat exchange.

Furthermore, since the peripheral portions of the two plates are brought into contact with each other along the whole peripheries, the cost of assembly can be reduced. Besides, since the plate type heat exchanger has a plurality of the opening portions in the plates, the heat exchanger can be constructed so that the internal fluid can flow in large quantities and the flow of the external fluid is not disturbed.

Next, a second embodiment of a plate type heat exchanger according to the present invention will be described below with reference to the accompanying drawings.

In the second embodiment of the present invention, plates have a shape suitable for meeting the following conditions: two plates having projections and depressions are piled on each other to form a space therebetween. When the peripheral portions and the opening portions (inlet and outlet for fluids) at both sides of the two plates are simply piled, the plates are brought into light contact (i.e., line contact) with each other along the whole peripheries. When a force in a direction of piling is increased, the contacting portions are changed in shape to be brought into surface contact with each other. When the force is increased until the projections and depressions of the respective plates are brought into contact with each other, the area of the contact surface is increased, and hence the peripheries of the plates can be sealed by brazing.

In the case of brazing, plates are brazed while a force is being applied in order to bring the plates into close contact with each other. Accordingly, the aforementioned plates are preferable because, upon application of this force, the peripheral portions of the plates become parallel, and further the projections and depressions of the plates are brought into contact with each other.

When the two plates described above are piled on each other while a brazing filler metal is laid (applied) at portions to be brought into contact with each other, a heat exchange element which has a fluid passage between the opening portions formed at both ends of the plates and the aforementioned space is formed. A desired number of heat exchange elements are piled on each other so that the opening portions communicate with each other among the heat exchange elements. The heat exchange elements are brazed in such a state that a force is being applied in a direction of piling. Consequently, the heat exchange elements are brought into contact with each other at a time, so that a plate type heat exchanger according to the present invention can be manufactured.

With the above arrangement, the projections and depressions of the plate can be formed as a curved pattern inside and outside heat exchange elements constituted by one type of plates (or two types of plates), and hence the heat exchanger has a highly efficient function of heat exchange.

The present invention can be applied to not only a case of brazing, but also a case where a gasket is interposed between the plates and a force is applied from the outside, and a case where the plates are sealed by welding.

In the case of welding or brazing, the plates are piled on and connected to each other while a force is being applied in a direction of piling. If the peripheral portions of the plates are in parallel with each other at a free state, then the applied force is likely to open the peripheral portions. Particularly in the case of brazing, the strength of the peripheral portions is extremely lowered.

When the plates are piled on each other while a brazing filler metal is laid between contacting portions and/or contact surfaces. The plates are heated in a furnace while a force is being applied in a direction of piling (a weight is being loaded on the plates), to be brazed at a time. Thus, the heat exchange structure is manufactured by one step, and the operation process can remarkably be simplified.

The projections and depressions of the plate according to the present invention can be formed as a corrugated pattern extending in a predetermined direction, and hence a complicated passage curved two-dimensionally can be formed with a relatively simple arrangement.

Further, the plate may have spot-like projections and depressions having a cross section of a circular shape or the like. When such plates are piled on each other, the size of the outer space and the size of the inner space can be changed to cope with an extremely low-pressure vapor.

Furthermore, one of the opening portions at both ends of the plate is provided with a rising portion, so that positioning of the plates upon piling can be facilitated by the fitting of the opening portions. Thus, the two-dimensional positioning of the plates can naturally be performed by simply piling the plates on each other. Consequently, the manufacturing process can be simplified.

Next, the second embodiment of the present invention will be described below with reference to the accompanying drawings.

Figure 5:
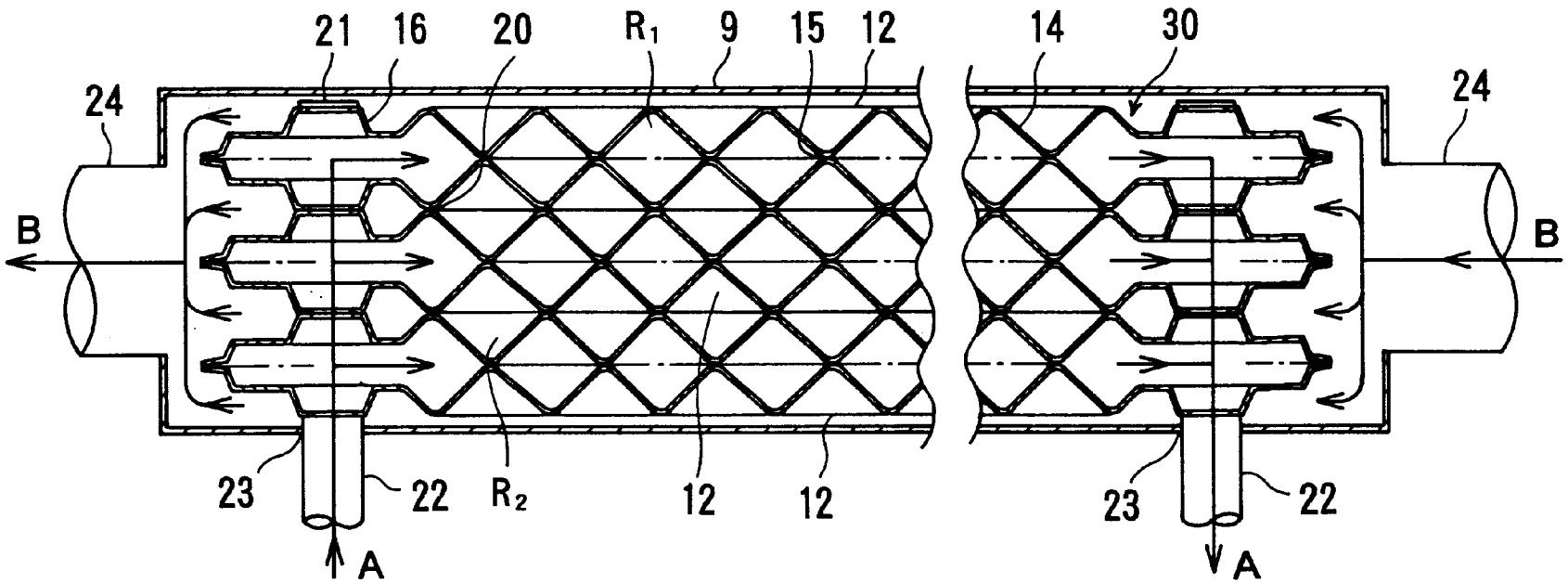
FIG. 5 is a schematic view showing a whole structure of a plate type heat exchanger according to a second embodiment of the present invention.

FIG. 5 is a sectional view showing a whole structure of a plate type heat exchanger according to the second embodiment of the present invention. As shown in FIG. 5, the plate type heat exchanger is constituted by mounting a heat exchange structure 30, which comprises three heat exchange elements 12 bonded to each other, in a shell 9 extending in a longitudinal direction.

Figure 6A:
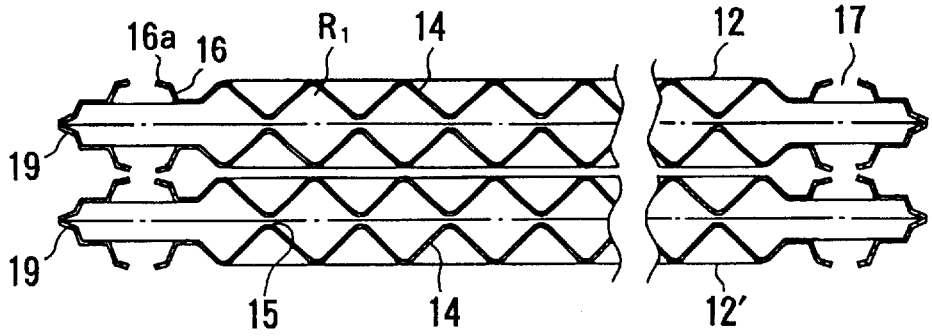
FIGS. 6A through 6D are schematic views explanatory of forming a plate according to the present invention.
Figure 6B:
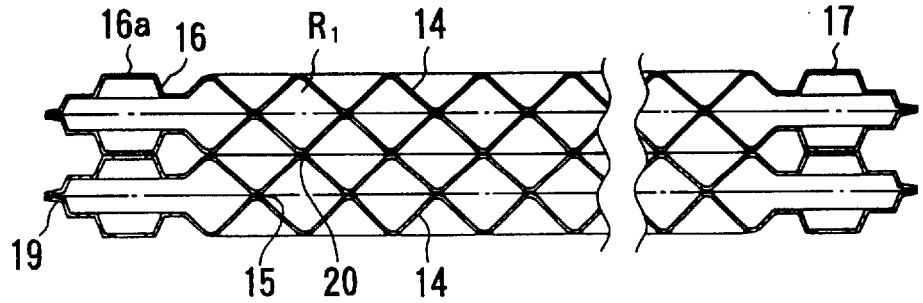

In the heat exchange element 12, as shown in FIG. 6A, when two plates 14 having projections and depressions in a corrugated pattern are spontaneously piled on each other, the peripheral contacting portions are brought into line contact with each other along the whole peripheries. On the other hand, an opening portion 17 is brought into line contact with an opening contacting portion 16*a* of an adjacent heat exchange element 12'. When a force (normally, a weight) is applied in a direction of piling, a space R1 is formed as a result of contact between the projections and depressions in the corrugated patterns, and the peripheral portions deform to be brought into surface contact with each other, as shown in FIG. 6B. The opening portions also deform such that the contacting portions 16*a* are brought into surface contact with each other. At this time, if the projections of the heat exchange element 12 are brought into contact with contacting portions 20 of the adjacent heat exchange element 12', then the heat exchange elements 12, 12' can be bonded to each other by brazing.

Figure 7:
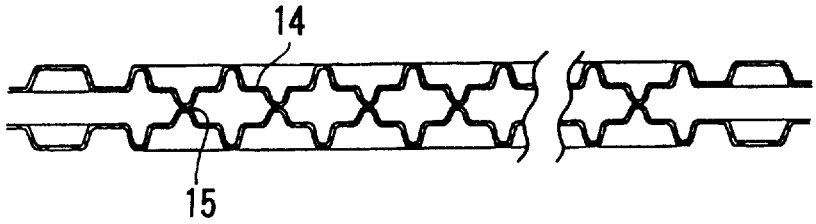
FIG. 7 is a vertical sectional view showing another heat exchange element used in the second embodiment of the present invention.

The projection-depression pattern may be a pattern suitable for appropriately disturbing the internal and external passages and ensuring strength, such as a corrugated pattern close to a sine wave as shown in FIG. 6A, or a pattern of circular protrusions as shown in FIG. 7.

Figure 8:
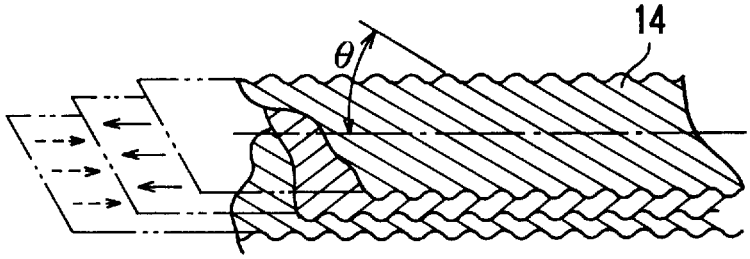
FIG. 8 is a schematic view showing a direction of plates when they are piled on each other.

The corrugated pattern is inclined at a predetermined angle θ to a longitudinal direction as shown in FIG. 8. Such plates 14 are alternately disposed in reverse directions so that the corrugated patterns cross each other.

Therefore, in the upper and lower plates 14, contacting portions 15 are formed at positions at which ridgelines of the corrugated patterns intersect in a mesh pattern, as shown in FIGS. 6A and 6B, so that curved passages are formed in the internal space R1.

Figure 6C:
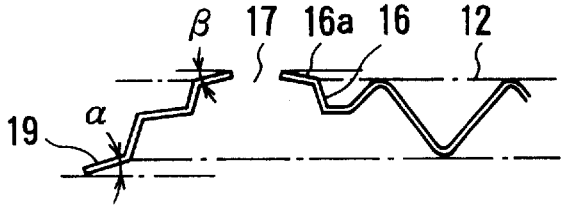
Figure 6D:
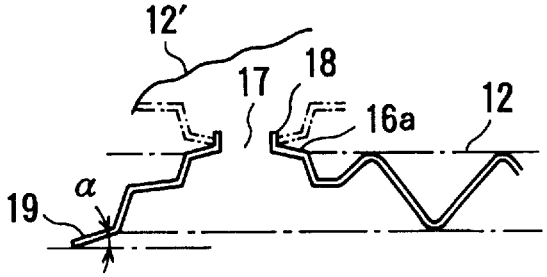
Figure 9:
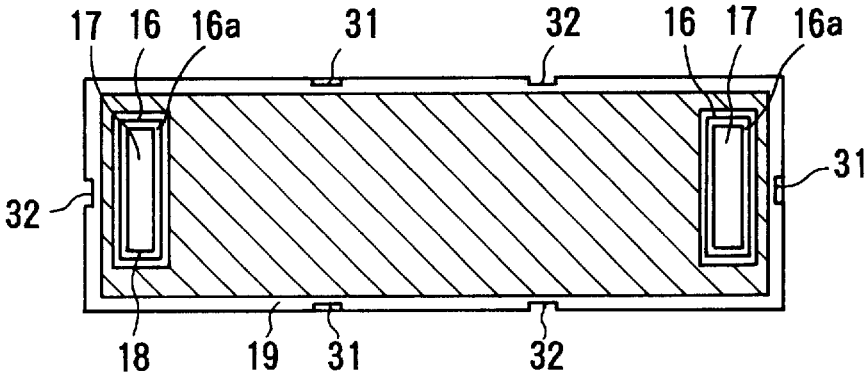
FIG. 9 is a plan view showing a structure of another plate used in the second embodiment of the present invention.

Truncated conical protuberances 16 are formed at both end of the plate 14. The contacting portion 16*a* at the upper end of the protuberance 16 has an inclination angle of β=about 1° to about 8° to the horizontal direction as shown in FIG. 6C. This contacting portion 16*a* is flattened when the heat exchange elements are piled on each other and a force is applied. The opening portion 17 is formed at the contacting portion 16*a*. As shown in FIG. 6D, a rising portion 18 is provided in one of the opening portions at both ends. When the rising portion 18 of the heat exchange element 12 is fitted into the opening portion of the adjacent heat exchange element 12' upon piling, positioning of the heat exchange elements upon piling can be facilitated. As shown in FIG. 9, the protuberance 16 and the opening portion 17 may have a rectangular shape, rather than a circular shape.

As shown in FIG. 6C, a peripheral contacting portion 19 of the plate 14 has an inclined surface. Thus, the peripheral contacting portions 19 are brought into line contact with each other when the heat exchange elements are faced to and piled on each other, and deform to be brought into surface contact with each other when a force is applied. The inclination of the peripheral contacting portion 19 is at an angle of α=about 1° to about 8°. When the heat exchange elements are piled on each other and a force is applied so that the contact portions 19 are brought into surface contact with each other, projection-depression patterns are brought into contact with each other, as shown in FIG. 6B. The plates 14 having the same shape are piled on each other in reverse directions.

In order to facilitate positioning when the heat exchange elements are faced to and piled on each other, projections and depressions, or protrusions 31 and notches 32 for engagement may be provided at several positions of the peripheral portion, as shown in FIG. 9.

The two plates 14 are piled on each other, and the contacting portions 15 of the projection-depression patterns and the peripheral portions 19 are welded or brazed to be bonded to each other, for thereby forming the heat exchange element 2.

In the example shown in FIG. 5, the heat exchange structure 30 is constituted by the three heat exchange elements 12 piled on each other, and the contacting portions 16*a* of the protuberances 16 are bonded to each other by welding or brazing, for thereby forming the heat exchange structure 30. As a result, a passage communicating with the space inside the shell is formed between the heat exchange elements 12.

As shown in FIG. 5, a shut-off plate 21 is secured to the opening portion 17 of the heat exchange element 12 on one side of the adjacent heat exchange elements 12 to close the opening portion 17. A pipe 22 for supplying the first heat exchange fluid into and discharging the first heat exchange fluid from the internal spaces R1 of the heat exchange elements 12 is connected to the opening portion 17 of the heat exchange element 12 on the other side. The end plate may have neither a shut-off plate 21 nor an opening portion 17. Through-holes 23 for disposing the pipes 22 are formed in the shell 9, and pipes 24 for supplying the second fluid into and discharging the second fluid from the space R2 in the shell are formed on walls on both sides in the longitudinal direction of the shell.

Particularly, if the truncated conical protuberance 16 has the same height as the corrugated projection and depression pattern, the contacting portions 20 of the adjacent heat exchange elements 12 and the contacting portions 16*a* of the protuberances 16 of the adjacent heat exchange elements 12 are welded or brazed to be bonded to each other, for thereby forming the heat exchange structure 30. Thus, the structural strength is further increased, and curved passages for communicating a space inside the shell are formed between the heat exchange elements 12, thereby increasing efficient function of heat exchange.

To manufacture such a plate type heat exchanger, the two plates 14 may be welded to form the heat exchange element 12, and the heat exchange elements 12 may be piled on each other and welded to form the heat exchange structure 30. In a simpler method, six plates 14 are piled on each other with a brazing filler metal interposed between the peripheral portions 19, between the contacting portions 16a of the opening portions, and between the contacting portions 15, 20 of the corrugated patterns, and heated in a furnace. In this manner, the heat exchange structure 30 can easily be manufactured by one step, and can be manufactured in large quantities depending on the capacity of the furnace.

As shown in FIG. 6D, one of the opening portions in the plate 14 may be provided with the rising portion to fit the rising portion into the opening portion of he adjacent heat exchange element. In addition, as shown in FIG. 9, protrusions 31 and notches 32 for engagement may be provided at several positions of the peripheral portion. Thus, when one heat exchange element is placed on another heat exchange element, the plates 14 are spontaneously positioned and stably supported by the protrusions 31 and the notches 32, for thereby further facilitating the aforementioned manufacturing process.

A brazing filler metal may be laid between the contacting portions 15, 20, between the peripheral portions 19, and at other necessary positions, as well as the heat exchange structure 30, and the plates 14, the shell 9, the pipes 22, 24, and the shut-off plate 21 are assembled and heated in the furnace to be brazed. Thus, the entire heat exchanger including the shell 9 can be manufactured at a time.

In the plate type heat exchanger thus formed, the first and second fluids are supplied to the supply and discharge pipe 22, 24 to perform heat exchange. When the fluid involving a phase change as a result of heat exchange, or low-pressure refrigerant vapor is supplied to the broader internal space R2 in the shell 9, the flows are smoothened. The first fluid flows through the passages in the heat exchange elements 12, as indicated by arrows A in FIG. 5. The second fluid flows through the passages formed between the heat exchange elements 12 or between the heat exchange elements 12 and the shell 9, as indicated by arrows B.

As described above, the corrugated patterns are formed in the plates 14 dividing the passages. Further, the corrugated patterns are inclined at a predetermined angle θ to the main direction of the flow between the opening portions 17. Thus, the passages are complicated such that the passages are curved upward, downward, rightward, and leftward. Therefore, the flow near the surface of the plate 14 becomes a turbulent flow, so that heat is efficiently exchanged between the flow and the plate 14.

Moreover, the projections and depressions formed in the plate 14 are formed in a corrugated pattern, and the corrugated patterns intersect at a predetermined angle. Thus, the intersections of the checkered ridgeline constitute the contacting portions 15, 20, which are arranged equally on the surfaces of the plates 14. This is preferred for the strength of the heat exchange structure 30.

It is advantageous from the viewpoint of heat transfer and strength that the shape of the projection-depression pattern of the plate is formed in a corrugated pattern close to a sine wave as shown in FIG. 6A. However, depending on the viscosity and phase change characteristics of the heat exchange fluid used, the projection-depression pattern may be a pattern of circular protrusions as shown in FIG. 7, or another shape may be selected as desired. The circular protrusions shown in FIG. 7 can be changed in height by the projections and depressions, for thereby changing the sizes of the spaces R1 and R2.

Projections may further be provided in the projections of the corrugated pattern at suitable intervals, so that the space between the adjacent elements (i.e., space R2) can be ensured between the protrusions and between the opening portions 16*a*.

Figure 10:
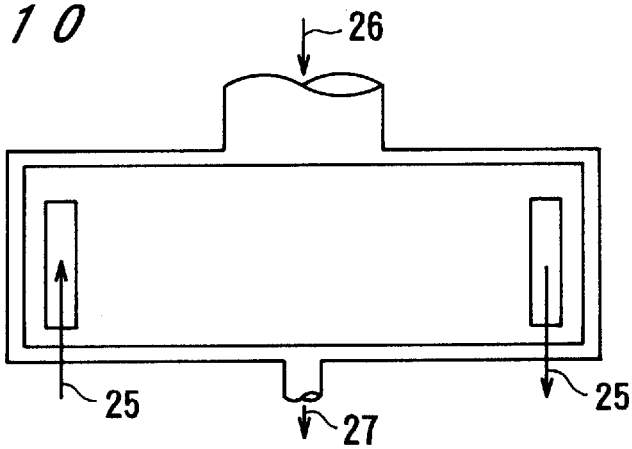
FIG. 10 is a schematic view showing a structure of the heat exchanger according to the second embodiment of the present invention which is used in a condenser of an absorption refrigerating machine.

The plate type heat exchanger according to the present invention can be applied to a condenser, a regenerator, an absorber, and an evaporator of an absorption refrigerating machine. In the case of a condenser, for example, as shown in a schematic structural view in FIG. 10, cooling water 25 is flowed through the R1 side, and a refrigerant vapor 26 from the regenerator is introduced into the R2 side from an upper portion and withdrawn as a refrigerant liquid 27 from a lower portion.

Figure 11:
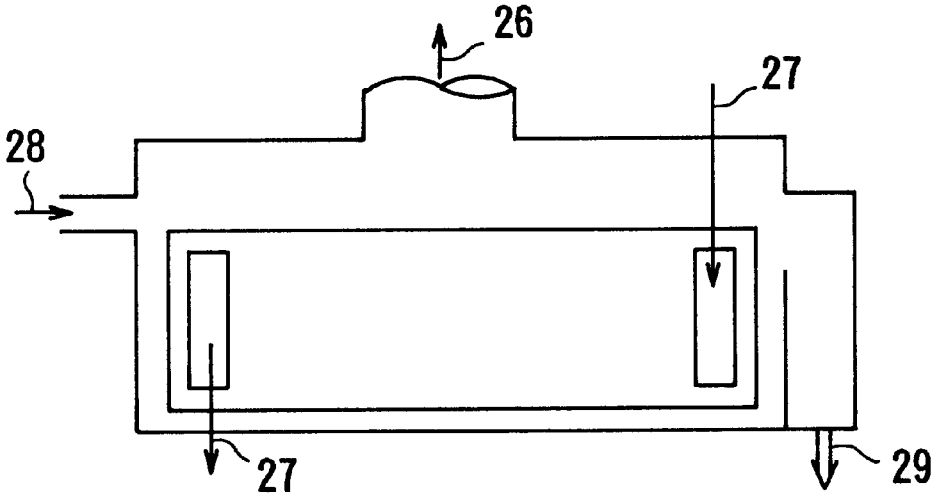
FIG. 11 is a schematic view showing a construction of the heat exchanger according to the second embodiment of the present invention which is used in a regenerator of an absorption refrigerating machine.

In the case of a regenerator, as shown in a schematic structural view in FIG. 11, a heat source fluid 27 (hot water or vapor in a single effect absorption refrigerating machine, or a refrigerant vapor from a high-temperature regenerator in a multiple effect absorption refrigerating machine) is introduced into R1, a dilute solution 28 is introduced into R2, and the refrigerant 26 is generated from an upper portion of the heat exchanger. The reference numeral 29 denotes a concentrated solution. When vapor is used in the R1 side, it is desirable that the opening portion is formed in a rectangular shape spreading over the entire width as shown in FIG. 9 to facilitate discharge of the condensate.

According to the second embodiment of the present invention, projections and depressions of plates can form curved passages inside and outside heat exchange elements constituted by one type of plates or two types of plates. Hence, a heat exchanger having a highly efficient function of heat exchange can be manufactured at low cost by a small number of components and a simple manufacturing process.

Further, the contacting portions of the projections and depressions are bonded to each other, for thereby increasing the strength. Furthermore, the projections and depressions are formed at certain intervals to perform heat exchange uniformly. Thus, a heat exchanger having a highly efficient function of heat exchange without thermal deformation can be manufactured.

Particularly, the projections and depressions are formed in a corrugated pattern. Hence, a heat exchanger having a highly efficient function of heat exchange in which complicated passages curved two-dimensionally are formed with a relatively simple arrangement can be provided at low cost. Further, the plates are constituted such that a brazing filler metal is laid between folded peripheral portions of the adjacent plates, and the peripheral portions have parallel contact surfaces when a force for brazing is applied, and the plates are bonded to each other by brazing. In this manner, firm and leakless bonding is carried out at low cost by a relatively simple working process. In this case, the use of so-called furnace brazing can remarkably simplify the work process and can reduce the cost.

Next, a third embodiment of the present invention will be described below with reference to the accompanying drawings.

The entire structure of a plate type heat exchanger according to the third embodiment of the present invention is the same as that of the plate type heat exchanger shown in FIGS. 1A and 1B, and hence will not be described.

Figure 12:
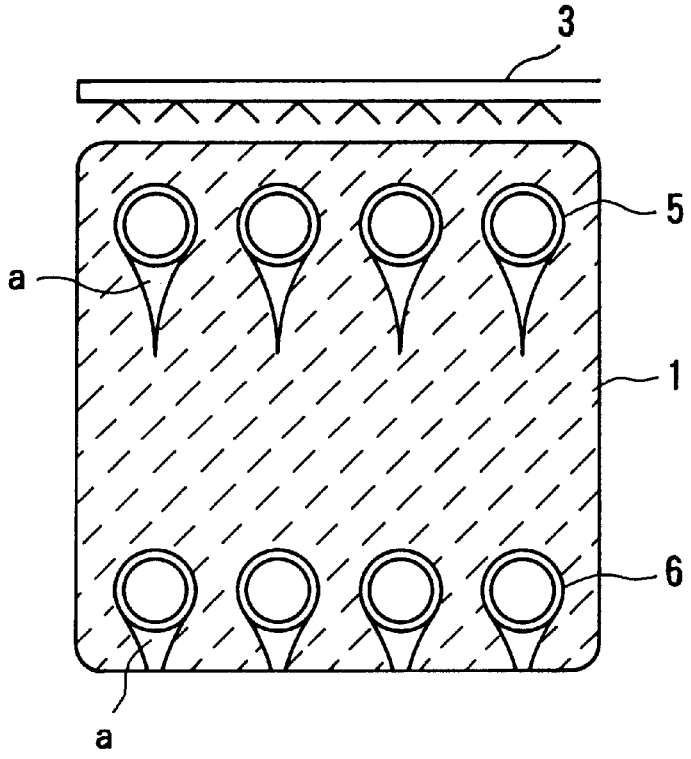
FIG. 12 is a schematic view explanatory of a liquid flow of an external fluid on a plate in a third embodiment of the present invention.
Figure 13:
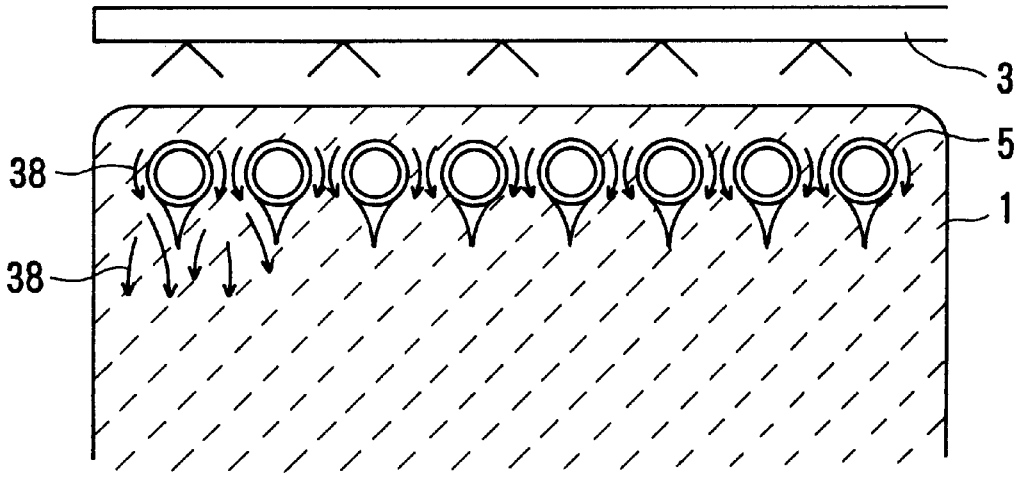
FIG. 13 is a partial enlarged view showing a liquid flow of an external fluid on another plate in the third embodiment of the present invention.

FIG. 12 is a schematic view explanatory of a liquid flow on a surface of a plate when an external fluid is sprayed on the plate in the plate type heat exchanger shown in FIGS. 1A and 1B. In FIG. 12, a hatched area represents regions of the liquid flow, and a liquid does not flow in a portion a below the opening portion (supply passage) 5, 6 without hatching. FIG. 13 is a partial enlarged view showing a plate in another example. In FIG. 13, the reference numeral 38 denotes a flow of an external fluid.

According to the present invention, as described above, at least one of the inlet and the outlet for an internal fluid comprises a plurality of supply passages 5, 6, and the internal fluid is supplied through the supply passages. Accordingly, compared with a conventional plate type heat exchanger, the size of the individual supply passage can be made small. Therefore, even at a high flow rate, the flow 38 of the external fluid is likely not to be prevented, and the liquid can easily flow within the portion below the supply passage, so that the heat transfer surface can effectively be used. Since the internal fluid is supplied through a plurality of supply passages, the internal flow becomes uniform, for thereby improving the performance of heat transfer. Liquid distributing portions around the ports can be made small, and the heat transfer area can be enlarged.

Even when the flow rate is increased, the number of supply passages is increased to cope with the increased flow rate.

Further, the supply passage can be designed so as to have moderate flow controllability. Therefore, as shown in FIG. 13, the supply passages are arranged laterally side by side in an upper portion of the heat exchanger, whereby the supply passages themselves can be used so as to serve as liquid distributors for the external fluid. A cylinder or a circular tube, which can be easily produced and processed, can be used for the supply passage. A turbulator (turbulence plate) may be inserted between the plates so that the external fluid generates the turbulence to flow uniformly, for thereby further improving the efficiency of heat exchange.

Figure 14A:
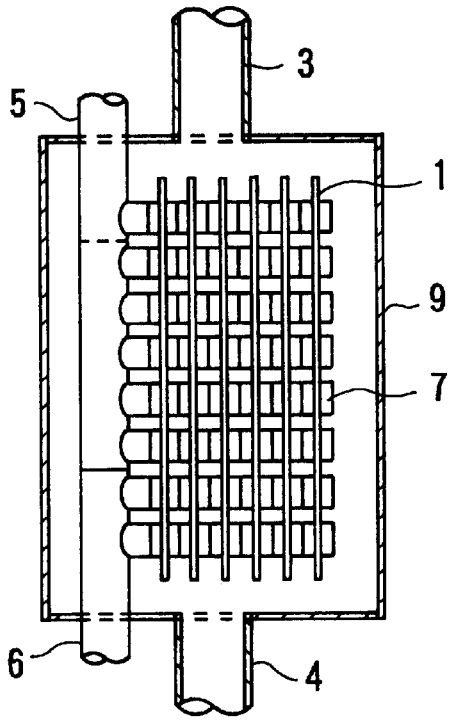
FIGS. 14A and 14B are schematic views showing a whole structures of another plate type heat exchanger according to the third embodiment of the present invention.
Figure 14B:
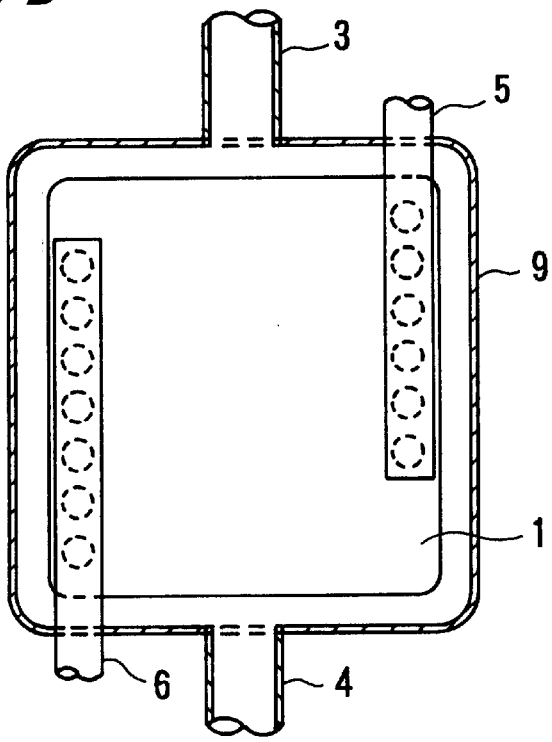

FIGS. 14A and 14B are schematic views showing a whole structure of another plate type heat exchanger according to the third embodiment of the present invention, and FIG. 14A is a front sectional view, and FIG. 14B is a side sectional view.

In FIGS. 14A and 14B, the respective reference numerals denote the same components as those shown in FIGS. 1A and 1B. In FIGS. 14A and 14B, an opening portion 5 constituting an internal fluid introduction passage (supply passage), and an opening portion 6 constituting a discharge passage (supply passage) are introduced into a shell 9 as a single tube, and connected to respective plates 1 through a plurality of internal fluid connecting tubes 7 in the shell. Thus, the internal fluid passages may be provided in a vertical direction, and comprise a plurality of passages in the shell.

Figure 15A:
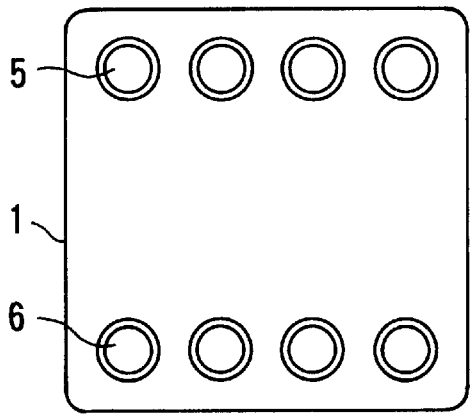
FIG. 15A is a front view showing a plate according to the third embodiment of the present invention.
Figure 15B:
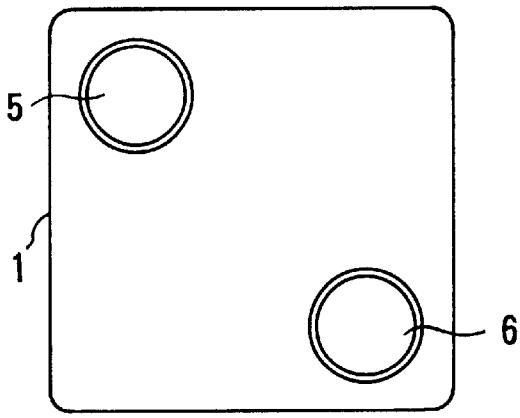
FIG. 15B is a front view showing a conventional plate.
Figure 16:
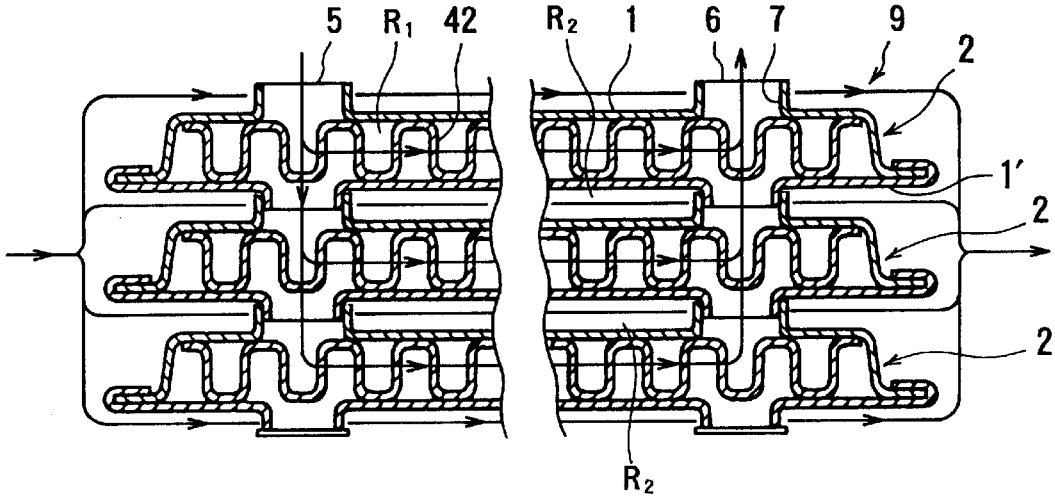
FIG. 16 is a sectional view showing a structure of a conventional heat exchanger.
Figure 17:
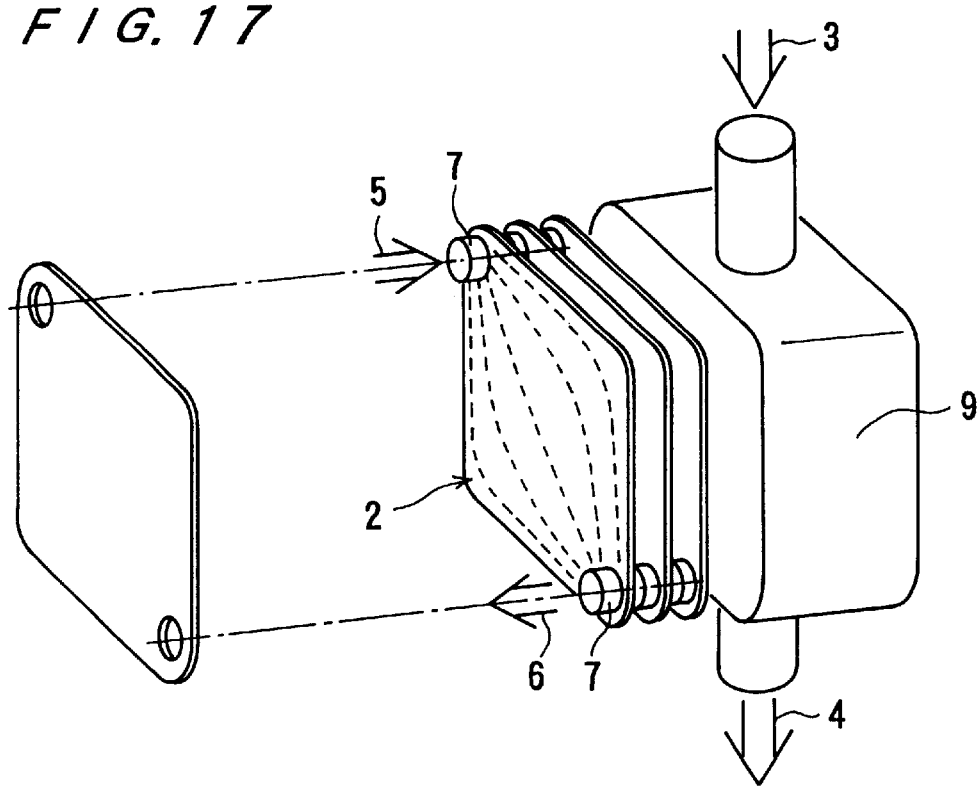
FIG. 17 is an exploded perspective view showing a conventional plate exchanger.
Figure 18:
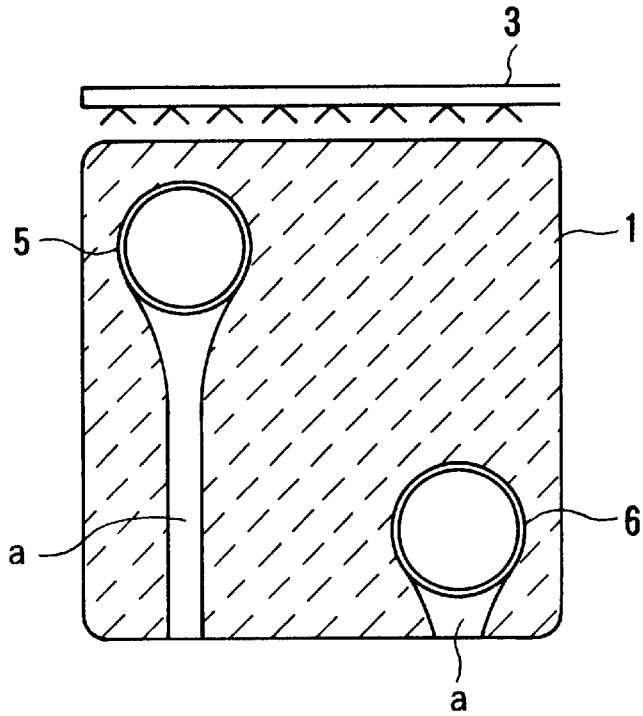
FIG. 18 is a schematic view explanatory of a liquid flow of an external fluid on a conventional plate.

In order to clarify the difference between the plate of the heat exchanger according to the present invention and the plate of the conventional heat exchanger, a front view of the plate according to the present invention is shown in FIG. 15A, and a front view of the conventional plate is shown in FIG. 15B.

According to the third embodiment of the present invention, the effects enumerated below can be obtained.

(1) An internal fluid at a high flow rate can be flowed.

(2) The flow of an external fluid is likely not to be prevented.

(3) A heat exchanger can be manufactured at low cost without complicated processes.

(4) The ports and the distributing portions can be made small, and hence the heat transfer area can be widened.

(5) The performance of heat transfer of the heat exchanger can be improved by using the supply passages as liquid distributors.

INDUSTRIAL APPLICABILITY

The present invention relates to a plate type heat exchanger for exchanging heat between two fluids flowing alternately through adjacent fluid passages between piled plates. The present invention can be used in an evaporator of a refrigerator, and an evaporator, a condenser, a regenerator, and an absorber of an absorption refrigerating machine.

What is claimed is:

1. A plate type heat exchanger having a shell containing a plurality of heat exchange elements, each of said heat exchange elements being composed of two plates for exchanging heat between an internal fluid flowing inside said heat exchange element and an external fluid flowing outside said heat exchange element characterized in that:

peripheral portions of said two plates being sealedly connected together to form an internal space in which said internal fluid flows and an external space in which said external fluid flows;

an introduction passage and a discharge passage being connected to said plates and communicating with said internal space for allowing said internal fluid to flow inside said two plates; and an introduction passage and a discharge passage being connected to said shell and communicating with an interior of said shell for allowing said external fluid to flow as a liquid film on surfaces of said plates within a space between the outside of said plates and said shell, wherein at least one of said introduction passage and said discharge passage for said internal fluid connected to each of said plates comprises a plurality of passages, and said passages including a sprayer provided above the heat exchange elements for spraying said external fluid on said plates to form a liquid film on the surfaces of said plates.

2. A refrigerating machine comprising said plate type heat exchanger according to claim 1 as at least one of an evaporator, an absorber, a regenerator, and a condenser.

3. A plate type heat exchanger according to claim 1, wherein said two plates have a plurality of depressions, and said depressions are brought into contact with and bonded to each other at contacting portions defined by said depressions, said depressions of said plates are each formed in a circular shape, or a horizontally elongated elliptic shape, and said contacting portions between said depressions each having a plane surface of at least 0.3 mm in width.

4. A plate type heat exchanger according to claim 3, wherein said peripheral portions of said two plates are brought into contact with each other along the whole peripheries of said plates upon piling, and contacting portions between said peripheral portions are sealed by bonding.

5. A plate type heat exchanger according to claim 1, wherein said heat exchange element has opening portions at both ends thereof, at least one of said opening portions is composed of a plurality of openings.

6. A plate type heat exchanger according to claim 3, wherein said heat exchange element has opening portions at both ends thereof, said plates of each heat exchange element are integrated by brazing said contacting portions at said peripheral portion and at said opening portions of said plates.

7. A plate type heat exchanger according to claim 1, wherein said two plates have projections and depressions formed in a shape inclined to one direction.

8. A plate type heat exchanger according to claim 1, wherein said two plates have projections and depressions formed as spot-like projections and depressions having a circular or other cross section, and the height of said projections is larger than the depth of said depressions when said heat exchange element is constituted.

9. A plate type heat exchanger according to claim 1, wherein each said plate has an opening portion containing a rising portion so that said rising portion is fitted into an opening portion of another plate when said plates are piled on each other.

* * * * *